US005460568A

United States Patent [19]

Yukimoto et al.

[11] Patent Number: 5,460,568

[45] Date of Patent: Oct. 24, 1995

[54] COIN PROCESSOR

[75] Inventors: Koji Yukimoto, Sakado; Kenji Nishiumi, Hanno; Yoshinori Maruyama, Kawagoe, all of Japan

[73] Assignee: Kabushiki Kaisha Nippon Conlux, Japan

[21] Appl. No.: 59,648

[22] Filed: May 10, 1993

[30] Foreign Application Priority Data

May 13, 1992 [JP] Japan ..... 4-120757

[51] Int. Cl.[6] ..... G07D 1/00

[52] U.S. Cl. ..... 453/17; 453/41

[58] Field of Search ..... 453/2, 17, 21, 453/32, 37, 40, 41, 58; 194/216, 217, 218

[56] References Cited

U.S. PATENT DOCUMENTS

| | | | |
|---|---|---|---|
| 3,215,151 | 11/1965 | Heim et al. | 453/17 |
| 3,814,115 | 6/1974 | Van Acker | 453/41 |
| 3,935,873 | 2/1976 | Johnson | 453/41 |
| 4,010,765 | 3/1977 | Clay | 453/21 |
| 4,250,905 | 2/1981 | Kobayashi et al. | 453/41 |
| 4,257,436 | 3/1981 | Smith | 453/41 |
| 4,266,563 | 5/1981 | Fujita | 453/41 |
| 4,266,564 | 5/1981 | Coburn et al. | 453/41 |
| 4,313,450 | 2/1982 | Kirisawa | 453/41 |
| 4,347,924 | 9/1982 | Hayashi et al. | 453/2 X |
| 4,361,161 | 11/1982 | Johnson | 453/41 |
| 4,367,760 | 1/1983 | Thomas et al. | 453/41 |
| 4,607,650 | 8/1986 | Kobayashi et al. | 453/40 |
| 4,616,323 | 10/1986 | Hayashi . | |
| 4,706,202 | 11/1987 | Kobayashi et al. . | |
| 4,834,689 | 5/1989 | Levasseur | 453/21 |
| 5,011,456 | 4/1991 | Kobayashi et al. | 453/32 |

FOREIGN PATENT DOCUMENTS

| | | | |
|---|---|---|---|
| 0116215 | 8/1984 | European Pat. Off. | 453/17 |
| 0397353 | 4/1990 | European Pat. Off. . | |
| 2035971 | 4/1971 | Germany | 453/41 |
| 2544673 | 4/1976 | Germany | 453/17 |
| 2334664 | 1/1979 | Germany | 453/41 |

*Primary Examiner*—Michael S. Huppert
*Assistant Examiner*—Scott L. Lowe
*Attorney, Agent, or Firm*—Welsh & Katz, Ltd.

[57] ABSTRACT

A coin processor which includes a coin selecting section for discriminating whether inserted coins are genuine or false and denominations of genuine coins, and guiding false coins to a predetermined coin passageway and the genuine coins to respective predetermined coin passageways in accordance with their denominations, a coin accommodating section for accommodating the genuine coins in accordance with their denominations, a coin payment section for paying out from the coin accommodating section coins of denominations corresponding to an amount of change, a detection section for detecting a quantity of coins stored in the coin accommodating section and, a time control section for controlling an interval of time for payment of the stored coins in accordance with the stored quantity of coins detected by the detection section.

11 Claims, 7 Drawing Sheets

COIN PROCESSOR

BACKGROUND OF THE INVENTION

1. Field of the Invention

The present invention relates to a coin processor for use with vending machines, money exchangers, service machines, etc., for separating inserted coins into genuine ones and false ones, accommodating the genuine coins in accordance with their denominations and paying out the accommodated coins as change.

2. Description of the Related Art

Generally, vending machines, money exchangers, service machines, etc., are provided with a coin processor for discriminating whether inserted coins are genuine or false, accommodating the genuine coins in accordance with their denominations and paying out the accommodated coins as change.

The coin processor is provided with a coin selecting section for separating inserted coins into genuine ones and false ones and further separating the genuine coins in accordance with their denominations. The coin selecting section is provided with complicated coin passageways for classifying the inserted coins as genuine ones or false ones and further separating the genuine coins in accordance with their denominations. The coin selecting section is also provided, on a part of the complicated coin passageway, with a selecting device comprised of a coil sensor having, for example, an oscillating coil and a receiving coil for discriminating whether inserted coins are Genuine or false and determining denominations of the Genuine coins, and a plurality of levers for Guiding the inserted coins to predetermined coin passageways. The selecting device is arranged to separate, while the coins are rolling respectively along the predetermined coin passageways, the inserted coins into the genuine ones and the false ones, to classify the Genuine coins in accordance with their denominations and to Guide the false ones into a predetermined passage and the Genuine coins into predetermined passageways each provided for each of the denominations.

The Genuine coins which have passed through the predetermined passageways are accommodated in accordance with their denominations in a coin accommodating section comprised of coin tubes disposed at a lower portion of the coin processor and, when the denominations of change are specified, the coins in the coin accommodating section are selected in accordance with an amount of the change and paid out downward out of the coin processor.

FIG. 5 is a cross-sectional view of the essential portion of an illustrative coin payment section 1 of the coin processor. The coin payment section 1 includes a bottom base 3 having a hole 2 provided for passing a coin therethrough, a payment plate 5 having a hole 4 corresponding in size to the hole 2 in the base 3 and being slidable back and forth (right and left directions in FIG. 5) on the bottom base 3, a coin tube 6 for accommodating the selected coins, a lever 7 for sliding the plate 5 back and forth, and a solenoid 9 having a lever drive shaft 8 for driving the lever 7.

FIG. 5 shows the solenoid 9 in a deenergized state in which the plate 5 is positioned at a backward position (at a right-hand position in FIG. 5). When the solenoid 9 is energized, the lever drive shaft 8 is drawn into the solenoid 9 to thereby turns the lever 7 in the clockwise direction around a shaft 10 and hence the plate 5 slides forward (in FIG. 5, leftward). When the solenoid 9 is deenergized, the lever drive shaft 8 is released from its drawn state to thereby turns the lever 7 in the counterclockwise direction around the shaft 10 and hence the plate 5 returns back to its original position.

FIGS. 6(a) to 6(d) are cross-sectional views of the essential portion of the coin payment section 1. FIGS. 6(a) to 6(d) show the respective operations of the coin payment section 1. FIG. 6(a) shows the coin payment section in a standby mode, where the coins within the coin tube 6 are placed on a predetermined position at an end of the plate 5. When the solenoid 9 is energized to turn the lever 7 clockwise as shown in FIG. 6(b), the plate 5 starts to slide in the forward direction. When the plate 5 moves to a predetermined forward position, as shown in FIG. 6(c), the lower open end of the coin tube 6 coincides with the hole 4 in the plate 5. Thus, the lowermost one of the coins accommodated in the coin tube 6 falls into the hole 4 in the plate 5. Thereafter, when the solenoid 9 is deenergized and thus the plate 5 slides in the backward direction to return to its original position, as shown in FIG. 6(d), the hole 4 in the plate 5 coincides with the hole 2 in the bottom base 3 and the coin in the hole 4 in the plate 5 is paid out downwardly. At this time, the coins remaining within the coin tube 6 are again placed on the predetermined position at the end of the plate 5, as shown in FIG. 6(a). Thereafter, similar operations are iterated to pay out a required number of coins.

FIG. 7 is a flowchart showing a conventional processing for coin payment operations. Now, payment of 25-cent coins will be described as a typical example. In the following description, T1 represents a time for which duration the solenoid is deenergized (the waiting time of the plate 5 at the backward position) while T2 represents a time for which duration the solenoid is energized (the waiting time of the plate 5 at the forward position), and a time taken for the plate 5 to slide to the predetermined forward or backward position is not included.

First, it is determined at step 101 whether 25-cent coins are to be paid out. If YES, it is determined at step 102 whether the time T1 has passed by referring to a timer T1. If the T1 has not passed, it means that coins are being paid out and thus the operation waits for the time T1. If the time T1 has passed, a solenoid for 25-cent coins is energized at step 103 and it is determined at step 104 whether the time T2 has passed by referring to a T2 timer. During the time T2, one coin is taken from the coin tube. When the time T2 has passed at step 104, the 25-cent coin solenoid is deenergized at step 105. By these operations, one coin is paid out. When coins are to be successively paid out, control returns to step 101 where the appropriate solenoid starts to be operated after the passage of the time T1. Thereafter, similarly, processing at steps 101–105 is iterated until all the change is paid out. Also, for 5- or 10-cent coins, the processing at steps 106–110 or 111–115 is performed as required.

As described above, the movement of the plate 5 for payment of the coins is determined depending on the timing of energization/deenergization of the solenoid 9. In the conventional coin processor, the times T1 and T2 are constant at all times irrespective of the number of coins stored in the coin tube.

As shown in FIG. 8, when the number of coins stored in the coin tube 6 decreases, a coin can jump up due to the reaction of the backward movement of the plate 5. If the next payment is performed before the jumped-up coin returns to the predetermined position at the end of the plate 5, no coin would fall into the hole in the plate 5 and normal payment of the coin would not be made disadvantageously. In this case, if the times T1 and T2 are set slightly longer than the conventional set times, the problem would be solved, but the payment speed would be slowed down. Thus, the time taken for the normal payment of coins would become longer accordingly.

SUMMARY OF THE INVENTION

The present invention is made in view of the above situation. It is an object of the present invention to provide a coin processor which ensures secure payment of coins at all times without reducing the normal coin payment speed.

In order to achieve the above object, the present invention provides a coin processor which comprises a coin selecting section for discriminating whether inserted coins are genuine or false and denominations of the coins discriminated as genuine ones, and guiding false coins to a predetermined coin passageway and the genuine coins in accordance with their denominations to predetermined coin passageways provided for the respective denominations, a coin accommodating section provided for each denomination for accommodating the genuine coins in accordance with their denominations into corresponding ones thereof, a coin payment section for paying out coins from the coin accommodating section in accordance with an amount of change, detection section for detecting a quantity of coins stored in the coin accommodating section and, time control section for controlling intervals of time for payment of the stored coins depending on the stored quantity of the coins detected by the detection section.

The object and advantages of the present invention will easily be confirmed on the basis of the following detailed description and the accompanying drawings.

DESCRIPTION OF THE PREFERRED EMBODIMENTS

One embodiment of a coin processor according to the present invention will be described below.

Figure 1:
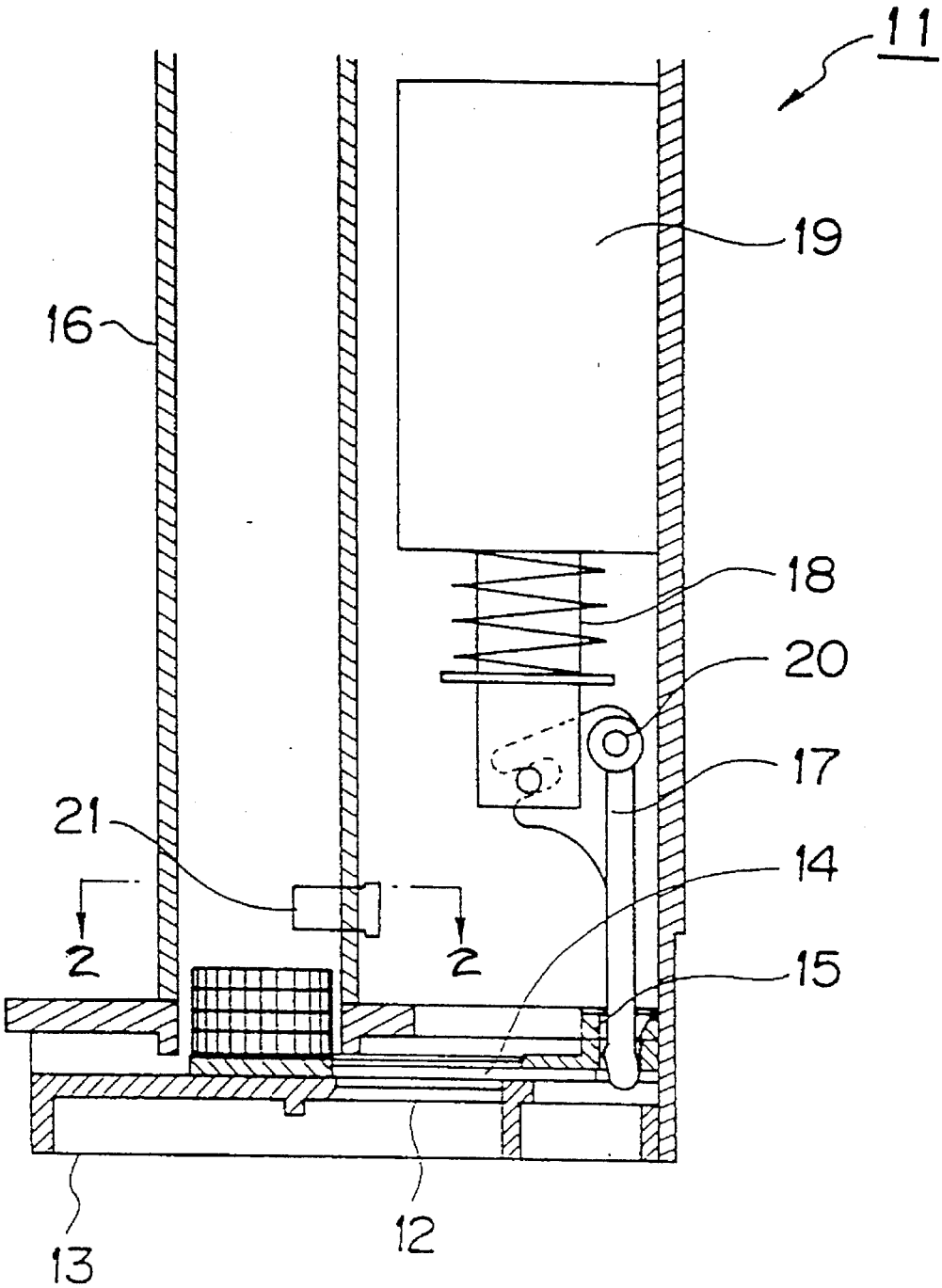
FIG. 1 is a cross-sectional view of the essential portion of an illustrative coin payment section of a coin processor according to the present invention.

FIG. 1 is a cross-sectional view of the essential portion of an illustrative coin payment section 11 disposed within a coin processor according to the present invention.

The coin payment section 11 includes a bottom base 13 having a hole 12 for passing a coin therethrough, a plate 15 provided to be slidable back and forth on the bottom base 13 and having a hole 14 corresponding in size to the hole 12 in the bottom base 13, a coin tube 16 for accommodating selected coins, a sensor 21 for detecting a quantity of coins stored in the coin tube 16, a lever 17 for sliding the plate 15 in back and forth directions and, a solenoid 19 having a lever drive shaft 18 for driving the lever 17.

The basic operations of the solenoid 19 and lever 17 of the coin payment section 11 are the same as those of the coin payment section 1 of FIG. 6. That is, when the lever drive shaft 18 moves up or down due to energization or deenergization of the solenoid 19, the lever 17 turns the clockwise or counterclockwise around a shaft 20 to thereby slide the plate 15 in the forward or backward direction.

Figure 2:
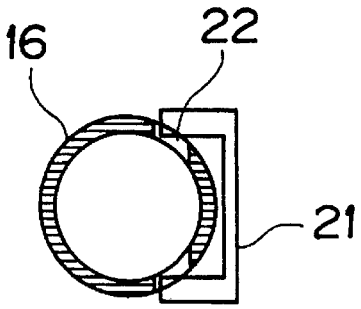
FIG. 2 is a cross-sectional view taken along the line 2—2 in FIG. 1.

As shown in FIG. 2, which is a cross-sectional view taken along the line 2—2 of FIG. 1, the sensor 21 is provided on a lower side of the coin tube 16 so as to detect a quantity of coins within the coin tube 16 through openings 22 formed on a side of the tube. While in the present embodiment an empty sensor is used to detect the quantity of coins, it may be replaced with a change storage quantity counter (number counter) disclosed, for example, in Japanese unexamined patent publication No. 56-11190, an optical sensor or a coil type sensor. In summary, any means or method may be used which is capable of sensing the quantity of coins within the coin tube.

Figure 3:
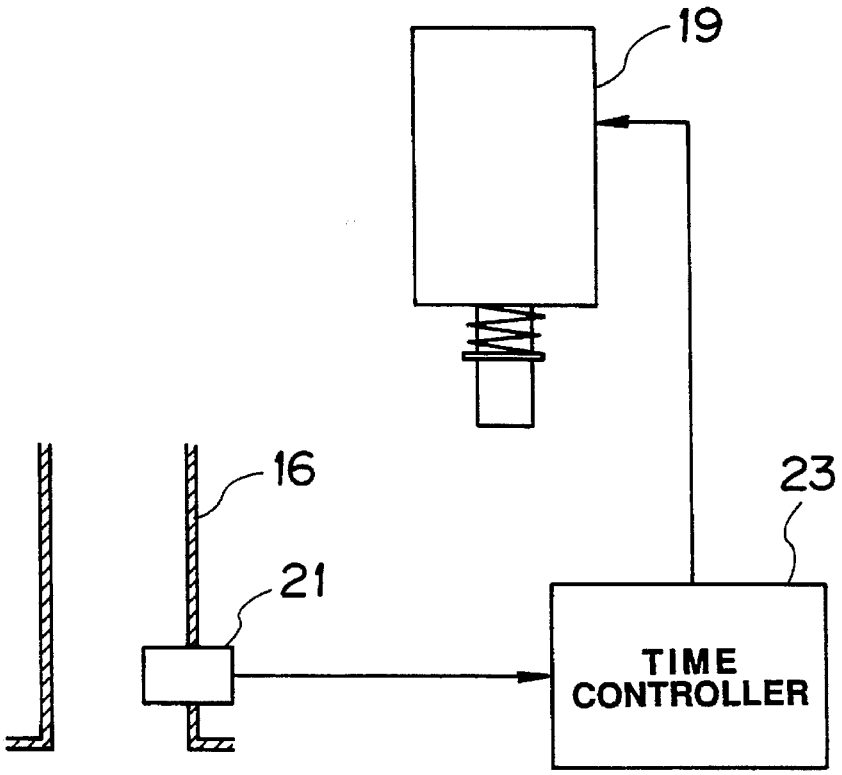
FIG. 3 is a block diagram of a control system of the coin payment section.

FIG. 3 is a block diagram of a control system of the coin payment section 11. The control system is provided with a sensor 21, a solenoid 19 and, a time controller 23 for controlling the timing of energization/deenergization of the solenoid 19. The time controller 23 controls as follows the intervals of time between the operations of the solenoid 19 in accordance with the stored quantity of coins detected by the sensor 21. T1 and T3 represent the intervals of time for which the solenoid 19 is in a deenergized state (the waiting time of the plate 15 at the backward standby position) while T2 represents the interval of time for which the solenoid 19 is in an energized state (the waiting time of the plate 15 at the forward standby position). When the height of the stored coins exceeds a position of the sensor 21 (normally), the control system delivers an operation signal to the solenoid 19 at the following timings:

T1=400 msec

T2=100 msec.

When the height of the stored coins is below the position of the sensor 21, the control system changes the setting of the interval of time from T1 to T3 and delivers an operation signal to the solenoid 19 at the following timings:

T3=900 msec

T2=100 msec.

According to this method, since the waiting or standby time of the plate 15 at the backward position increases, the jumped-up coin will again be placed at the predetermined position on the end of the plate 15. Thus, although payment is performed at the conventional timing, it is achieved securely.

The time controller 23 has timers for the respective times T1, T2 and T3 and refers to the appropriate timer on the basis of the detection of the sensor 21. The respective set times for the timers may be changed as required. The time controller 23 may include a peripheral circuit which mainly includes a central processing unit (CPU) and a main storage, and a program based on a flowchart to be described later.

While in the embodiment the time T2 is shown as being constant to minimize a decrease in the payment speed, it may be increased as required.

Figure 4:
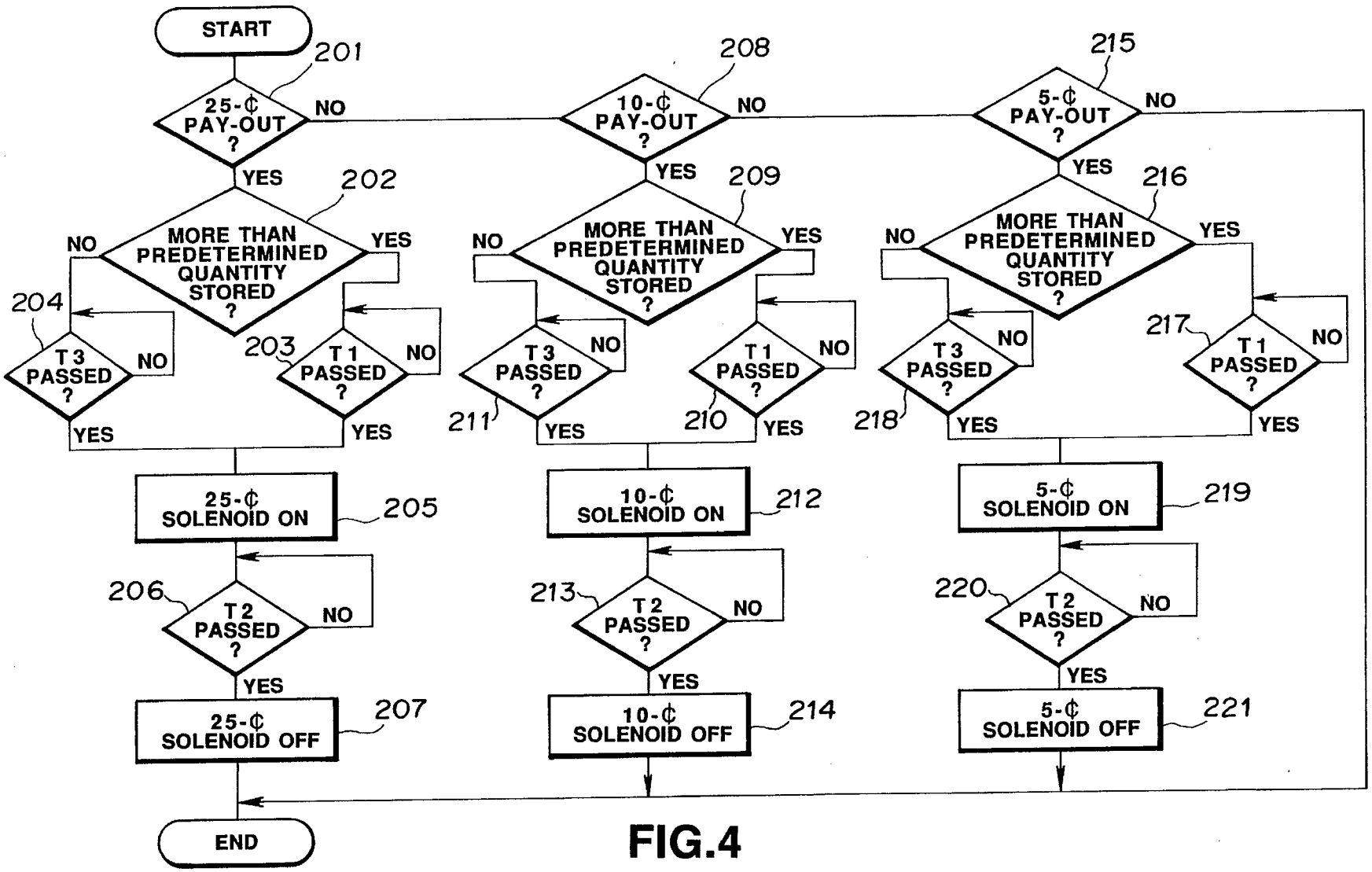
FIG. 4 is a flowchart showing the processing of coin payment operations of a time controller.
Figure 5:
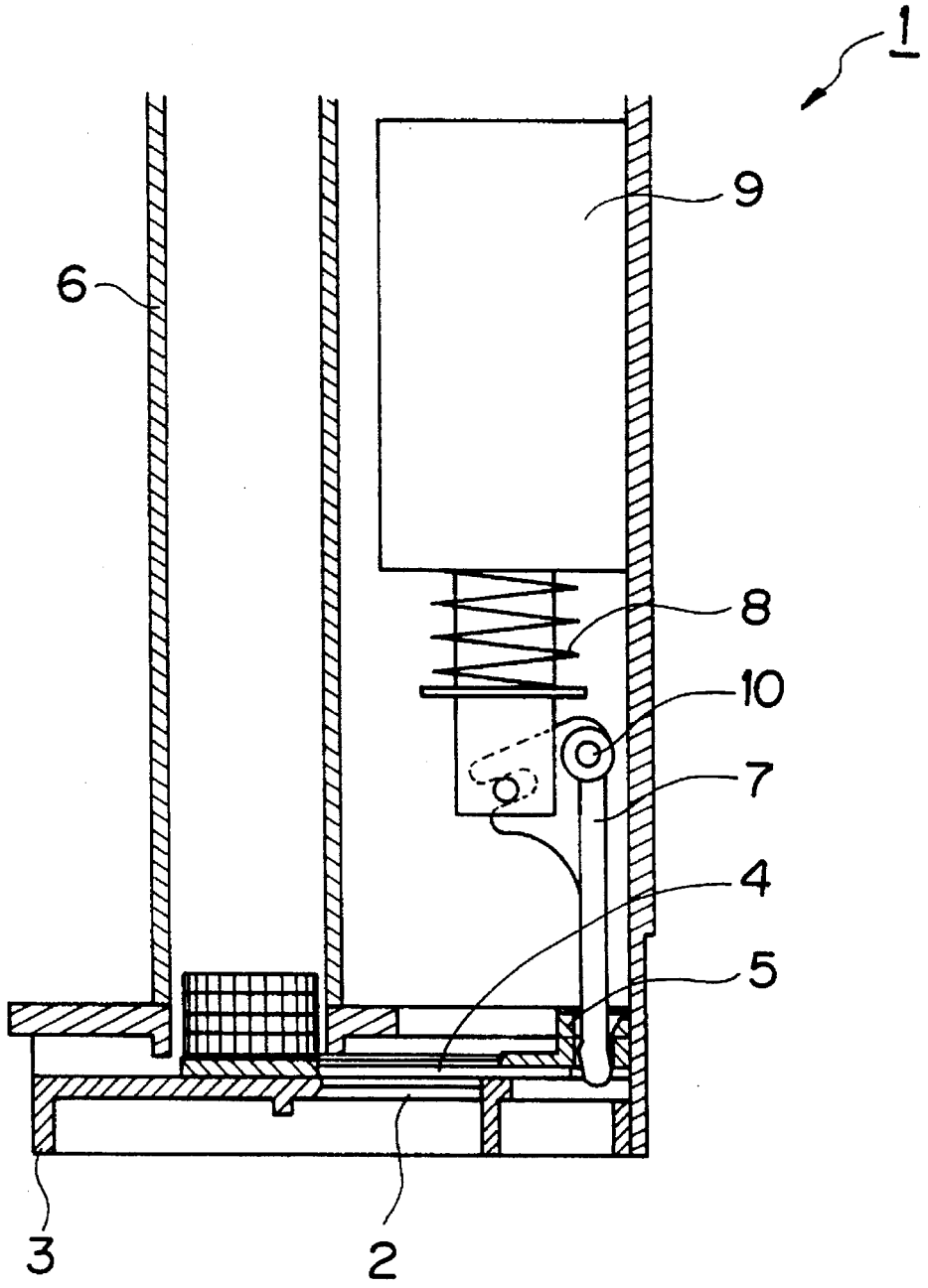
FIG.5 (PRIOR ART)
FIG. 5 is a cross-sectional view of the essential portion of a coin payment section of a conventional coin processor.
Figure 6A:
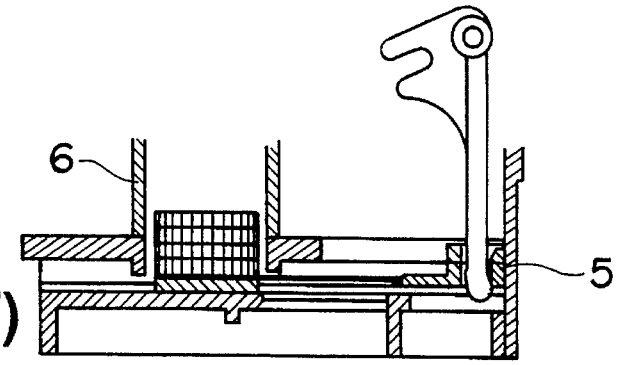
FIG.6(a) (PRIOR ART)
FIGS. 6(a) to 6(d) are cross-sectional views of the essential portion of the conventional coin payment section.
Figure 6B:
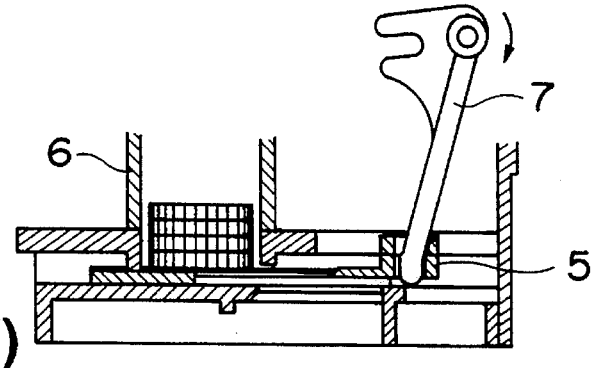
FIG.6(b) (PRIOR ART)
Figure 6C:
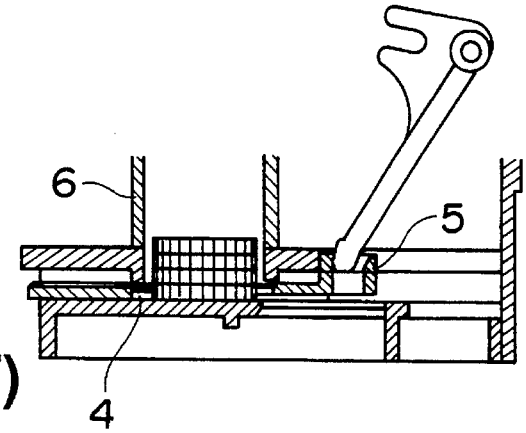
FIG.6(c) (PRIOR ART)
Figure 6D:
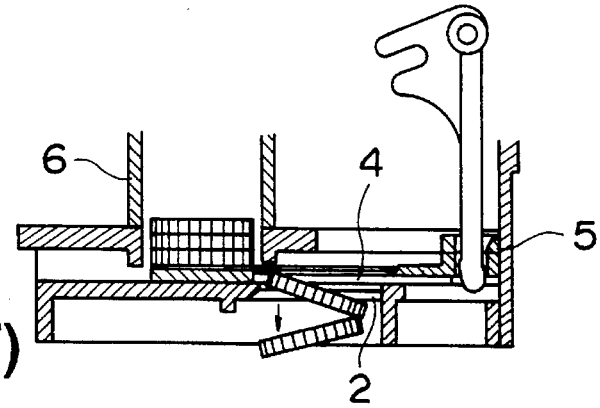
FIG.6(d) (PRIOR ART)
Figure 7:
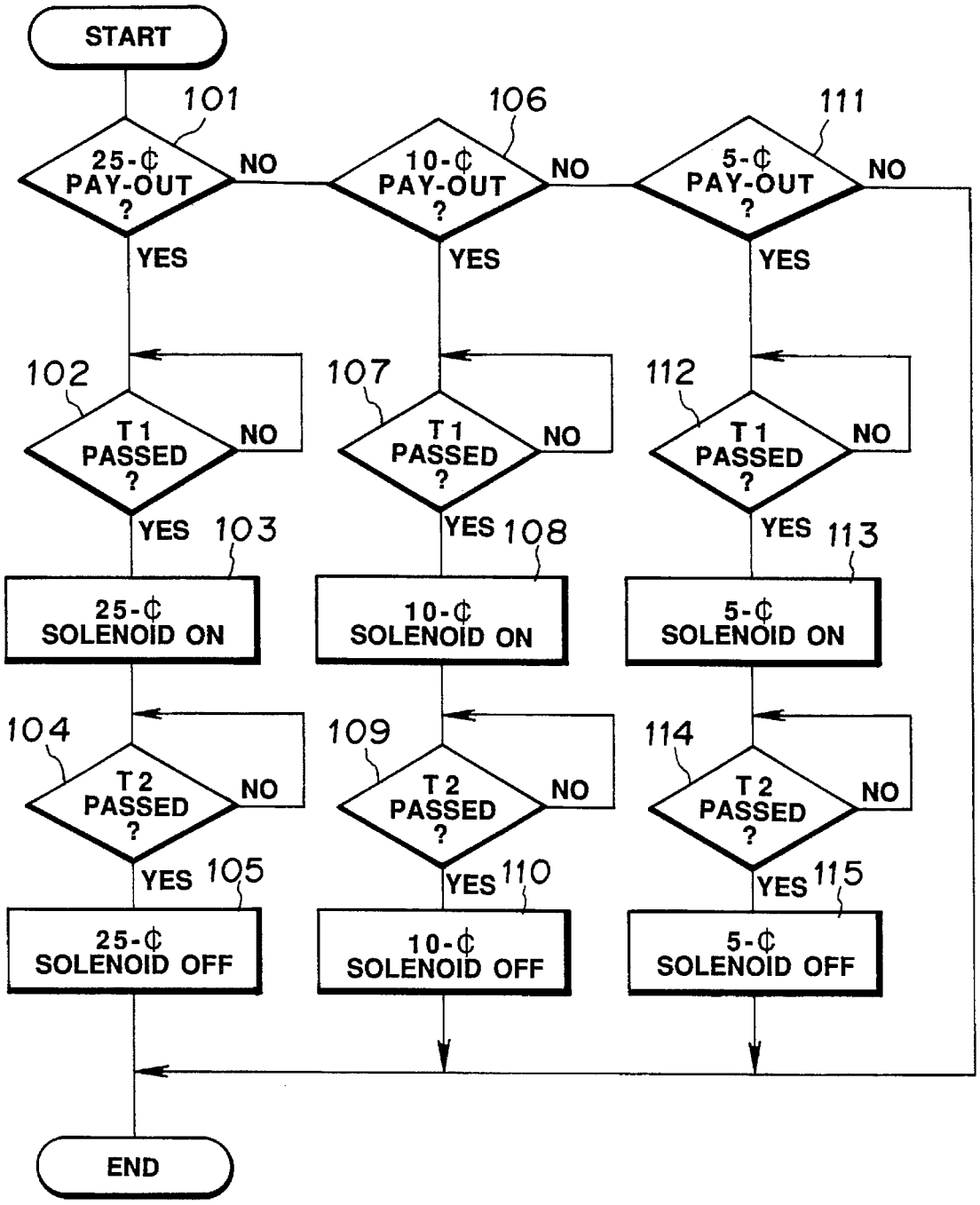
FIG.7 (PRIOR ART)
FIG. 7 is a flowchart showing a conventional processing of coin payment operations.
Figure 8:
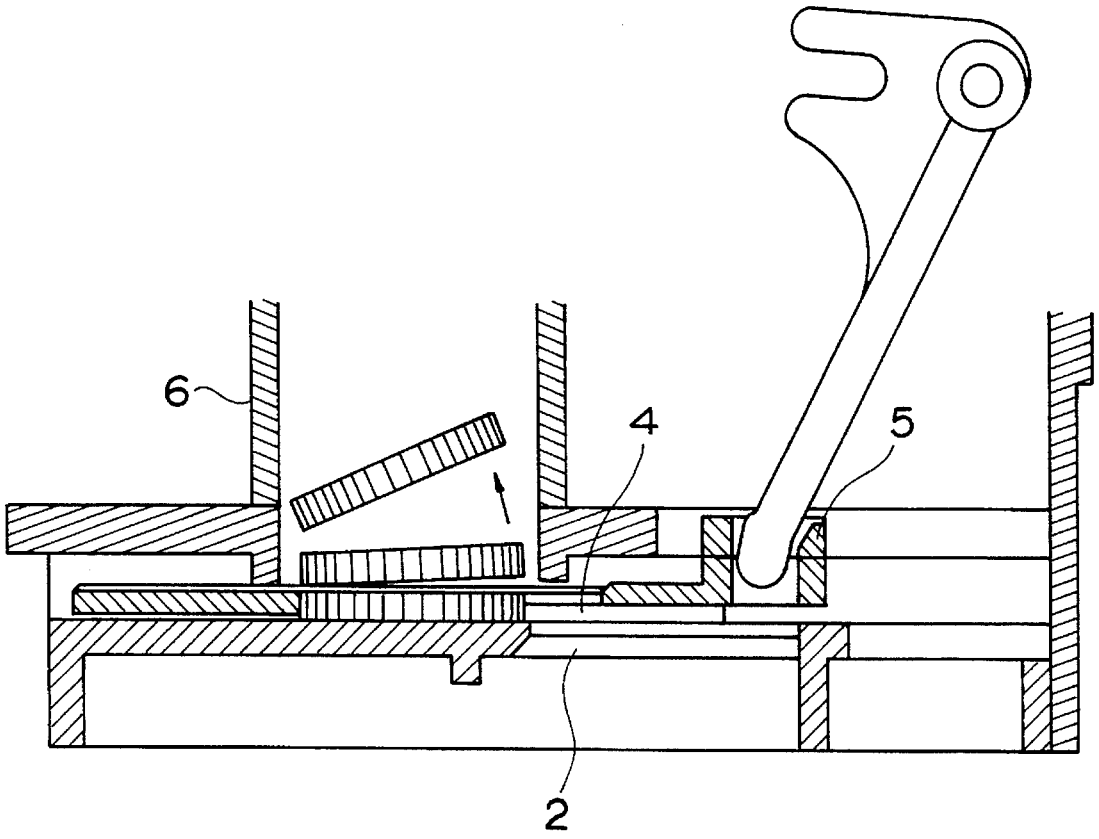
FIG.8 (PRIOR ART)
FIG. 8 is a cross-sectional view of the essential portion of the conventional coin payment section.

The process of payment of 25-cent coins in the time controller 23 will be described as a typical example by referring to the flowchart of FIG. 4.

First, it is determined at step 201 whether 25-cent coins are to be paid out. If YES, it is determined at step 202 whether there are at least a predetermined quantity of coins. If YES, it is determined at step 203 whether a time T1 has passed by referring to the T1 timer (normally). If NO at step 202, it is determined at step 204 whether the time T3 has passed by referring to the T3 timer. Since in the embodiment the T3 timer has an interval of time is 900 msec which is more than twice the normal interval of time, as mentioned above, the jumped-up coin falls onto the predetermined position at the end of the plate and can be put at the standby position for the next payment.

When either one of the T1 and T3 timers times out, the solenoid for a 25-cent coin is energized at step 205 to drop the coin into the hole in the plate. Then, it is determined at step 206 whether the time T2 has passed. If the time T2 has passed, the solenoid for the 25-cent coin is deenergized at step 207. By this series of operations, one coin is paid out. Similarly, the processing at steps 201–207 is then iterated until all the change is paid out. Also, for 10- or 5-cent coins, the processing at steps 208–214 or steps 215–221 is performed as required.

Thus, even if a coin jumps up due to a backward movement of the plate when the number of stored coins is small, it is given time enough to fall onto the predetermined position at the end of the plate. Thus, when the plate is moved forward by the following payment operation, the coin is ensured to fall into the hole in the plate.

In the present embodiment, the time T3 employed when the quantity of coins is small than the predetermined level is not limited to 900 msec, but may be suitable changed depending on the size and/or weight of the coin as required. While in the embodiment the control of payment of change is described in detail, the present invention is not limited to the embodiment. The present invention is applicable to payment of all coins within the coin tube responsive to the inventory operation, returning of inserted coins in accordance with a return command, etc.

As described above, since the time interval of payment is increased automatically when the quantity of coins stored in the coin accommodating section is less than a predetermined quantity, useless operations due to jumping up of coins are prevented which may occur when the storage quantity of coins is less than the predetermined quantity and invariably secure payment is ensured. In addition, since payment is made at normal intervals of time when the storage quantity of coins is more than the predetermined quantity, the normal speed of payment of coins is maintained.

The present invention can be carried out in other various forms and aspects without departing from its spirit and main features. Thus, the above embodiment is merely illustrative in every respect and should not be interpreted as being restrictive. The scope of the present invention is shown by the attached claims and not at all restricted by the text of the specification. It is to be noted that all changes and modifications falling within the scope of equivalents to the invention defined by the claims fall within the scope of the invention.

What is claimed is:

1. A coin processor including a coin selecting section for discriminating whether inserted coins are genuine or false and denominations of coins discriminated as genuine ones, and guiding false coins to a predetermined coin passageway and the genuine coins to respective predetermined coin passageways in accordance with their denominations, a coin accommodating section for accommodating the genuine coins in accordance with their denominations and, a coin payment section for paying out from the coin accommodating section, coins of denominations corresponding to an amount of change, the coin processor comprising:

detection means for detecting a quantity of coins stored in the coin accommodating section; and time control means for controlling an interval of time in the coin payment section for the payout of a coin, said interval of time being based on the stored quantity of coins detected by the detection means.

2. A coin processor according to claim 1, wherein the detection means comprises a sensor.

3. A coin processor according to claim 2, wherein the sensor is provided in the coin accommodating section.

4. A coin processor according to claim 3, wherein the coin accommodating section has an opening to permit detecting the stored quantity of coins.

5. A coin processor according to claim 1, wherein the detection means comprises a number counter and detects the stored quantity of coins on the basis of a content of the number counter.

6. A coin processor according to claim 1, wherein the time control means sets the interval of time of payment of the stored coins to be longer than a normal time when the stored quantity of coins is less than a predetermined quantity.

7. A coin processor including a coin selecting section for discriminating whether inserted coins are genuine or false and denominations of coins discriminated as genuine ones, and guiding false coins to a predetermined coin passageway and the genuine coins to respective predetermined coin passageways in accordance with their denominations, a coin accommodating section for accommodating the genuine coins in accordance with their denominations and, a coin payment section for paying out from the coin accommodating section coins of denominations corresponding to an amount of change, the coin processor comprising:

a sensor for detecting a quantity of coins stored in the coin accommodating section; and time control means for setting an interval of time for payment of the stored coins to be longer than a normal time when the stored quantity of coins detected by the sensor is less than a predetermined quantity.

8. A coin processor including a coin selecting section for discriminating whether inserted coins are genuine or false and denominations of coins discriminated as genuine ones, and guiding false coins to a predetermined coin passageway and the genuine coins to respective predetermined coin passageways in accordance with their denominations, a coin accommodating section for accommodating the genuine coins in accordance with their denominations and, a coin payment section for paying out from the coin accommodating section coins of denominations corresponding to an amount of change, the coin processor comprising:

a number counter for counting a quantity of coins stored in the coin accommodating section; and time control means for setting an interval of time for payment of the stored coins to be longer than a normal time when the stored quantity of coins counted by the number counter is less than a predetermined quantity.

9. A coin processor including a coin payment section which comprises a bottom base having a hole for passing a coin therethrough, a payment plate having a hole corresponding in size to the hole in the bottom base and disposed so as to be slidable back and forth on the bottom base, a coin tube in communication with said bottom base for accommodating genuine validated coins, a lever for sliding the payment plate back and forth and, a solenoid having a lever drive shaft for driving the lever, the coin processor comprising:

detection means for detecting a quantity of coins stored within the coin tube; and time control means for setting a standby time of the payment plate at a backward position to be longer than a normal time when the stored quantity of coins detected by the detection means is less than a predetermined quantity.

10. A coin processor including a coin payment section which comprises a bottom base having a hole for passing a coin therethrough, a payment plate having a hole corresponding in size to the hole in the bottom base and disposed so as to be slidable back and forth on the bottom base, a coin tube in communication with said bottom base for accommodating genuine-validated coins, a lever for sliding the payment plate back and forth and, a solenoid having a lever drive shaft for driving the lever, the coin processor comprising:

a sensor for detecting a quantity of coins stored in the coin tube; and time control means for setting a standby time of the payment plate at a backward position to be longer than a normal time when the stored quantity of coins detected by the sensor is less than a predetermined quantity.

11. A coin processor including a coin payment section which comprises a bottom base having a hole for passing a coin therethrough, a payment plate having a hole corresponding in size to the hole in the bottom base and disposed so as to be slidable back and forth on the bottom base, a coin tube in communication with said bottom base for accommodating genuine-validated coins, a lever for sliding the payment plate back and forth and, a solenoid having a lever drive shaft for driving the lever, the coin processor comprising:

a number counter for counting a quantity of coins stored in the coin tube; and time control means for setting a standby time of the plate at a backward position to be longer than a normal time when the stored quantity of coins counted by the number counter is less than a predetermined quantity.

* * * * *